US005144701A

United States Patent [19]

Clark

[11] Patent Number: 5,144,701

[45] Date of Patent: Sep. 8, 1992

[54] WHEEL CHAIR SHAMPOO APPARATUS

[76] Inventor: Ralph W. Clark, 3581 NW. Broad, Roseburg, Oreg. 97470

[21] Appl. No.: 622,543

[22] Filed: Dec. 5, 1990

[51] Int. Cl.[5] ..... A45D 19/00; A45D 19/04

[52] U.S. Cl. ..... 4/515; 4/516; 4/518; 4/519

[58] Field of Search ..... 4/515, 516, 517, 518, 4/519, 520, 523, 619; 312/228, 229; 280/304.1; 297/310, Dig4; 414/678

[56] References Cited

U.S. PATENT DOCUMENTS 3,733,620 5/1973 Glintz ..... 4/515
4,660,233 4/1987 Beaver ..... 4/517
5,007,118 4/1991 Ebersole ..... 4/515

*Primary Examiner*—Henry J. Recla
*Assistant Examiner*—David J. Walczak
*Attorney, Agent, or Firm*—Leon Gilden

[57] ABSTRACT

An apparatus for mounting and positioning a wheel chair in a tilted association to a shampoo basin, wherein the organization includes a housing with spaced side walls defining an upper basin and a floor positioned below the basin for orienting a container for receiving fluid directed through the basin from a fluid container mounted overlying the basin. The housing includes spaced parallel slider bars positioned laterally of the basin and extend ible forwardly to position and mount wheel chair handle bars, with a wheel chair forward wheel support mount arranged to position the forward wheels of a wheel chair thereon.

4 Claims, 5 Drawing Sheets

PRIOR ART

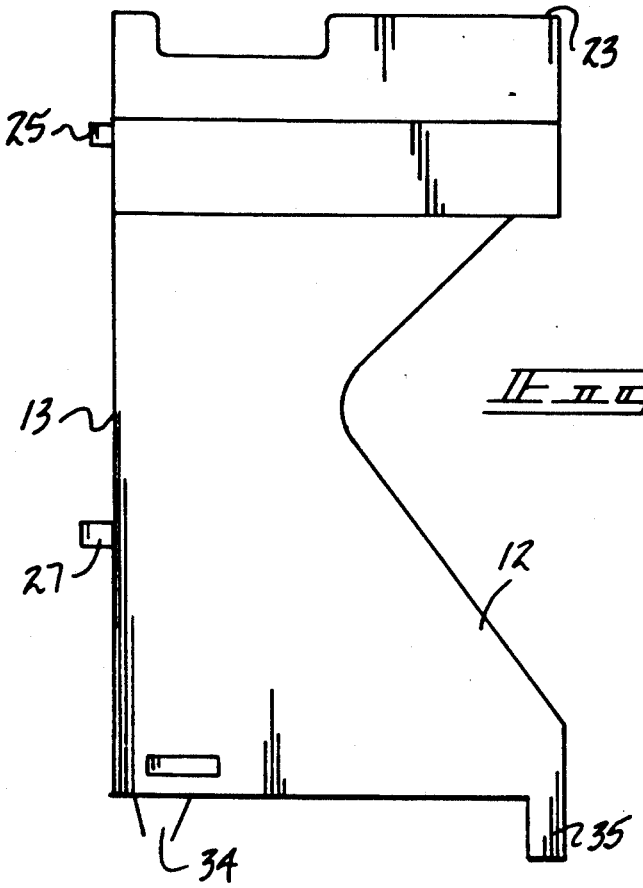
FIG 4
FIG 5
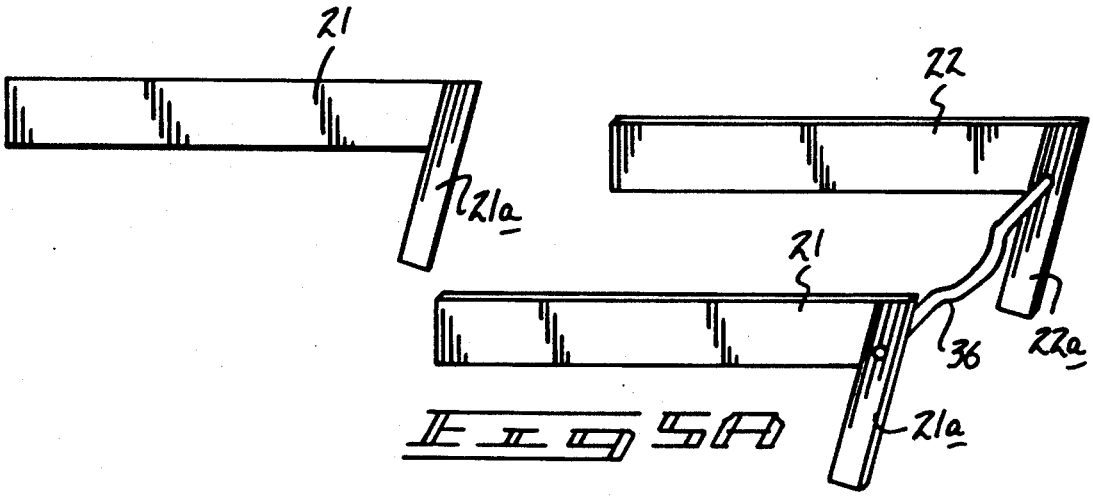
FIG 5A

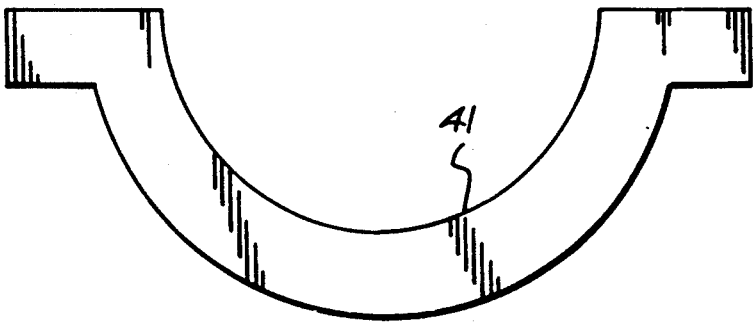
FIG 8
FIG 9
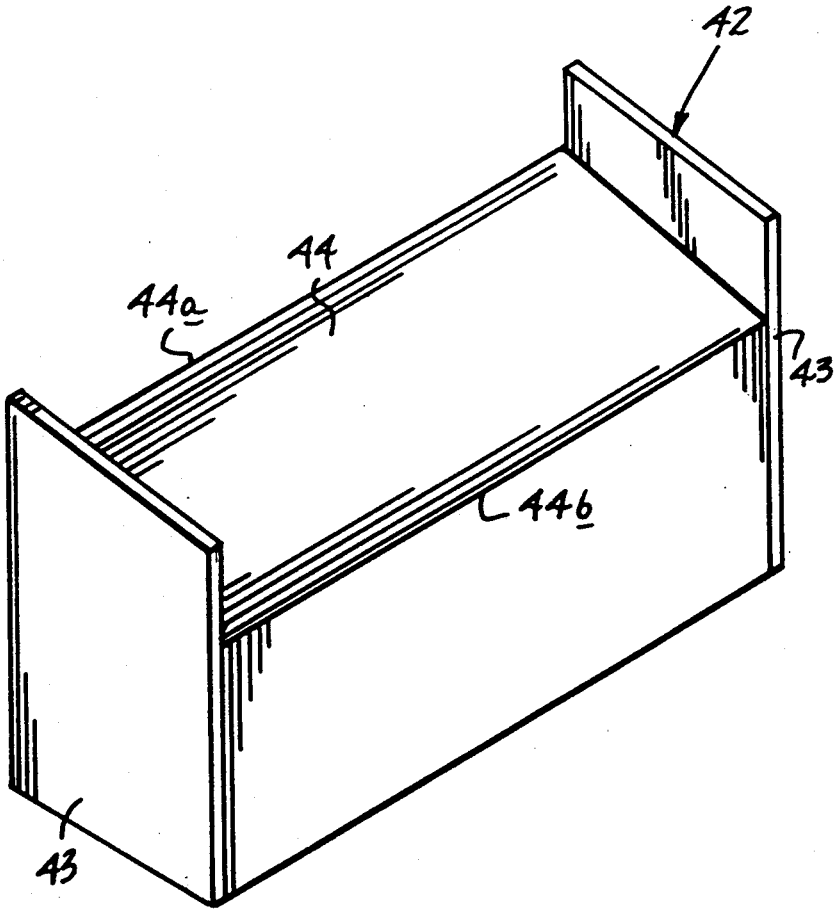

WHEEL CHAIR SHAMPOO APPARATUS

BACKGROUND OF THE INVENTION

1. Field of the Invention

The field of invention relates to shampoo stations, and more particularly pertains to a new and improved wheel chair shampoo apparatus wherein the same mounts and positions a wheel chair in a desired orientation relative to a shampoo basin to effect hair shampooing of an individual within a wheel chair.

2. Description of the Prior Art

Shampoo stations of various types have been provided in the prior art. Such stations are typically not adapted and arranged for shampooing of individuals mounted within a wheel chair. Such individuals requiring hygienic care includes regular intervals of hair shampooing. An example of a prior art hair shampoo organization arranged for use with a wheel chair may be found in U.S. Pat. No. 4,821,347 to Nash wherein a wash basin organization mounted with a housing utilizes a scissor-type linkage to tilt the basin structure forwardly of the housing.

U.S. Pat. No. 4,660,233 to Beaver sets forth a portable shampoo and manicuring apparatus utilizing a complex array of nozzles in a work station scenario.

U.S. Pat. No. 1,244,535 to Nutter sets forth a shampoo stand of conventional configuration, with a fixed basin mounted overlying a support housing.

U.S. Pat. No. 3,849,806 to Strickland, et al. sets forth a shampoo bowl assembly with a shampoo station utilizing conventional plumbing in a fixed position for use with chair structure.

U.S. Pat. No. 3,523,306 to Sabella sets forth a portable shampoo arrangement wherein a fixed basin is mounted within a housing that is positionable relative to various work stations, wherein each work station includes plumbing for use with a basin.

As such, it may be appreciated that there continues to be a need for a new and improved wheel chair shampoo apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of wheel chair shampoo apparatus now present in the prior art, the present invention provides a wheel chair shampoo apparatus where in the same mounts a basin fixedly within a housing permitting slide rails mounted adjacent the basin to be adjusted forwardly to support a mounted handle bar structure of an associated wheel chair arranged at a tilted orientation relative to the basin. As such, the general purpose of the present invention, which will be desribed subsequently in greater detail, is to provide a new and improved wheel chair shampoo apparatus which has all the advantages of the prior art wheel chair shampoo apparatus and none of the disadvantages.

To attain this, the present invention provides an apparatus for mounting and positioning a wheel chair in tilted association to a shampoo basin, wherein the organization includes a housing with spaced side walls defining an upper basin and a floor positioned below the basin for orienting a container for receiving fluid directed through the basin from a fluid container mounted overlying the basin. The housing includes spaced parallel slider bars positioned laterally of the basin and extendible forwardly to position and mount wheel chair handle bars, with a wheel chair forward wheel support mount arranged to position the forward wheels of a wheel chair thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with the patent or legal terms or phraseology, to determine quickly from a cursory inspection the nature and essence of the technical disclosure of the application. The abstract is neither intended to define the invention of the application, which is measured by the claims, nor is it intended to be limiting as the scope of the invention in any way.

It is therefore an object of the present invention to provide a new and improved wheel chair shampoo apparatus which has all the advantages of the prior art wheel chair shampoo apparatus and none of the disadvantages.

It is another object of the present invention to provide a new and improved wheel chair shampoo apparatus which may be easily and efficiently manufactured and marketed.

It is a further object of the present invention to provide a new and improved wheel chair shampoo apparatus which is of a durable and reliable construction.

An even further object of the present invention is to provide a new and improved wheel chair shampoo apparatus which is susceptible of a low cost of manufacture with regard to both materials and labor, and which accordingly is then susceptible of low prices of sale to the consuming public, thereby making such wheel chair shampoo apparatus economically available to the buying public.

Still yet another object of the present invention is to provide a new and improved wheel chair shampoo apparatus which provides in the apparatuses and methods of the prior art some of the advantages thereof, while simultaneously overcoming some of the disadvantages normally associated therewith.

Still another object of the present invention is to provide a new and improved wheel chair shampoo apparatus wherein the same provides for a secure and tilted mounteing of a wheel chair structure relative to a shampoo basin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic side view, taken in elevation, of the housing utilized by the instant invention.

FIG. 5 is an orthographic side view of the slider bar assembly utilized by the instant invention.

FIG. 5*a* is an isometric illustration of the slider bar assembly utilized by the instant invention.

FIG. 8 is an orthographic front view, taken in elevation, of the wash basin entrance collar utilized by the instant invention.

FIG. 9 is an isometric illustration of the wheel chair support mount utilized by the instant invention.

DESCRIPTION OF THE PREFERRED EMBODIMENT

Figure 1:
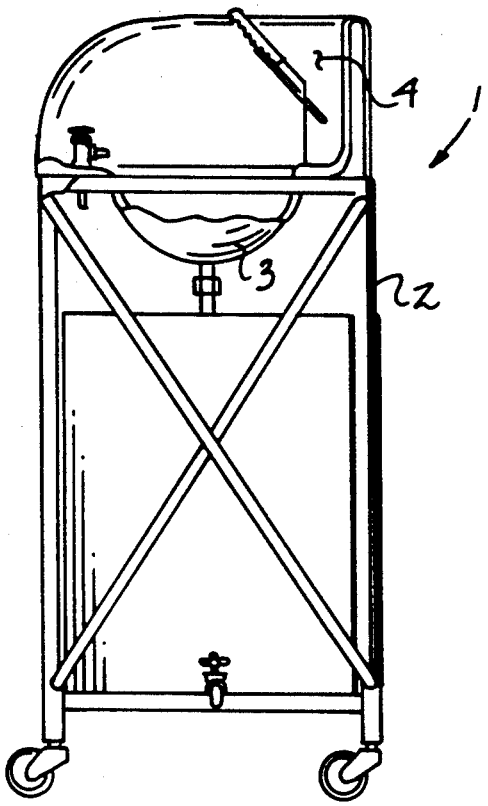
FIG 1 PRIOR ART
FIG. 1 is an orthographic side view, partially in section, of a prior art shampoo apparatus.

With referece now to the drawings, and in particular to FIGS. 1 to 9 thereof, a new and improved wheel chair shampoo apparatus embodying the principles and concepts of the present invention and generally designated by the reference numeral 10 will be described.

Figure 2:
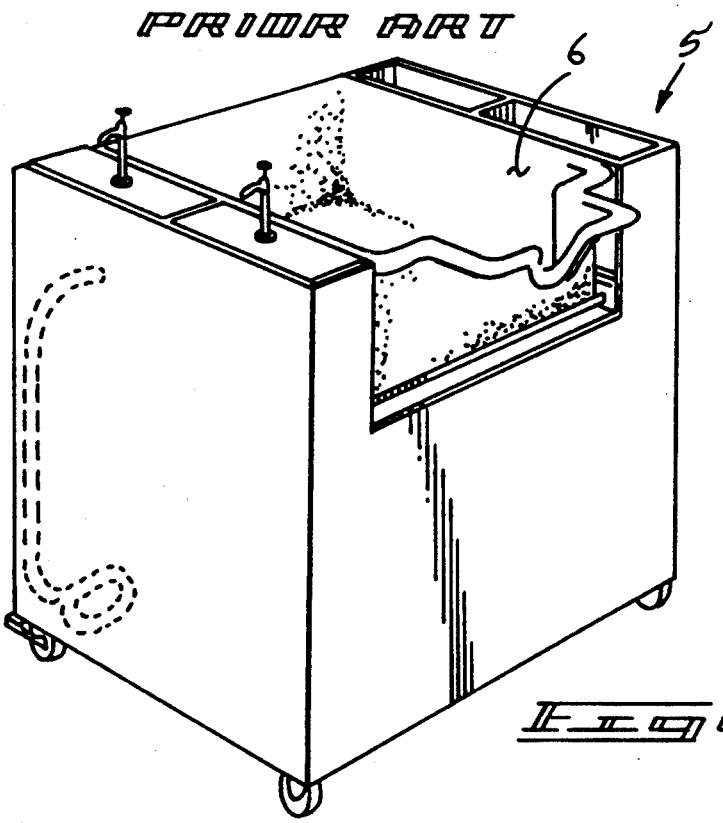
FIG. 2 is an isometric illustration of prior art wheel chair shampoo work station.

FIG. 1 illustrates a prior art shampoo stand 1, wherein a housing or framework 2 mounts a basin 3 at an upper portion thereof within a sink assembly 4, as set forth in U.S. Pat. No. 1,244,535. FIG. 2 illustrates a prior art wheel chair assembly 5, wherein the sink assembly 6 is positionable exteriorly of the housing utilizing a scissor-like mounting as set forth in U.S. Pat. No. 4,821,347.

Figure 3:
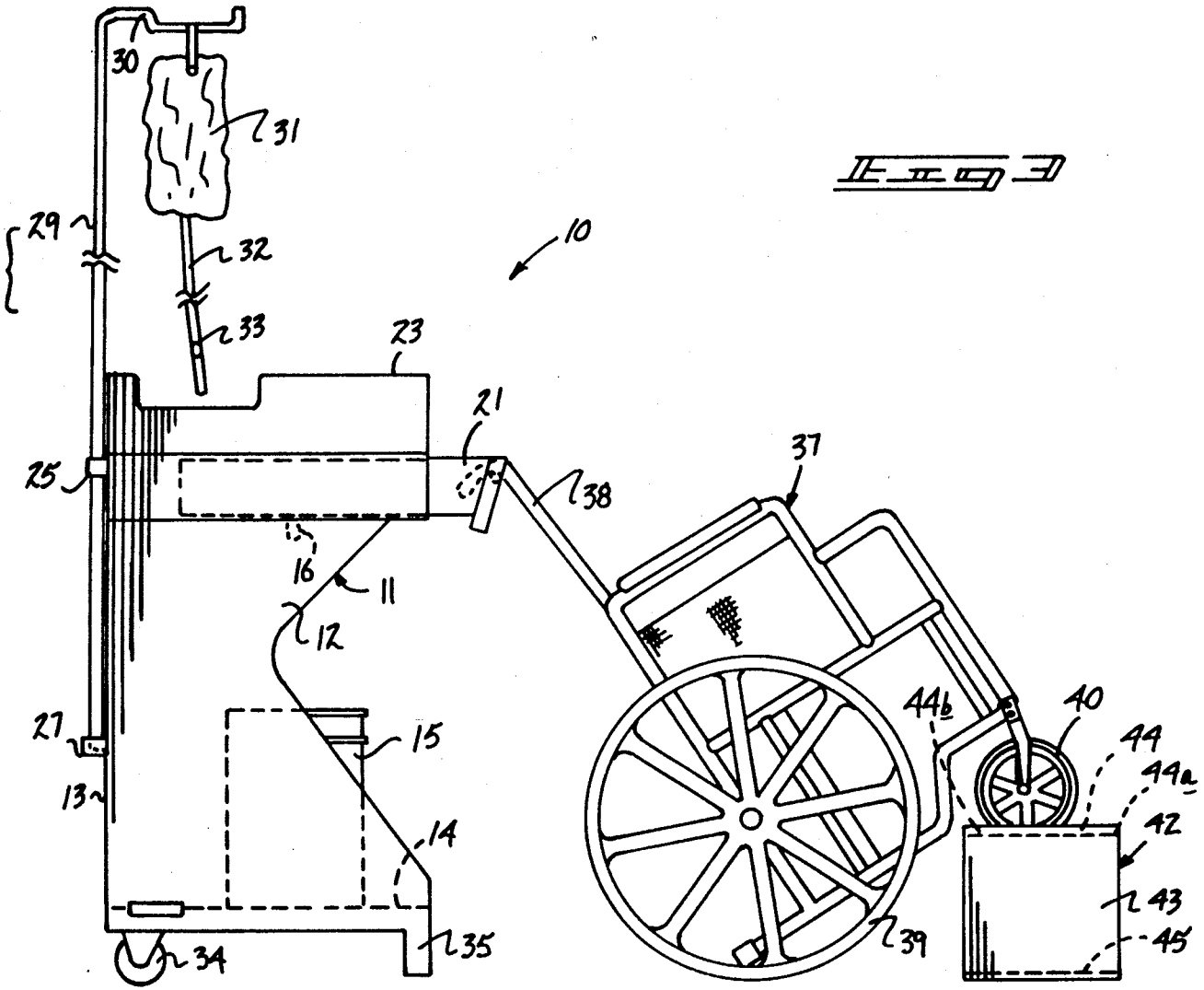
FIG. 3 is an orthographic side view, taken in elevation, of the instant invention.
Figure 6:
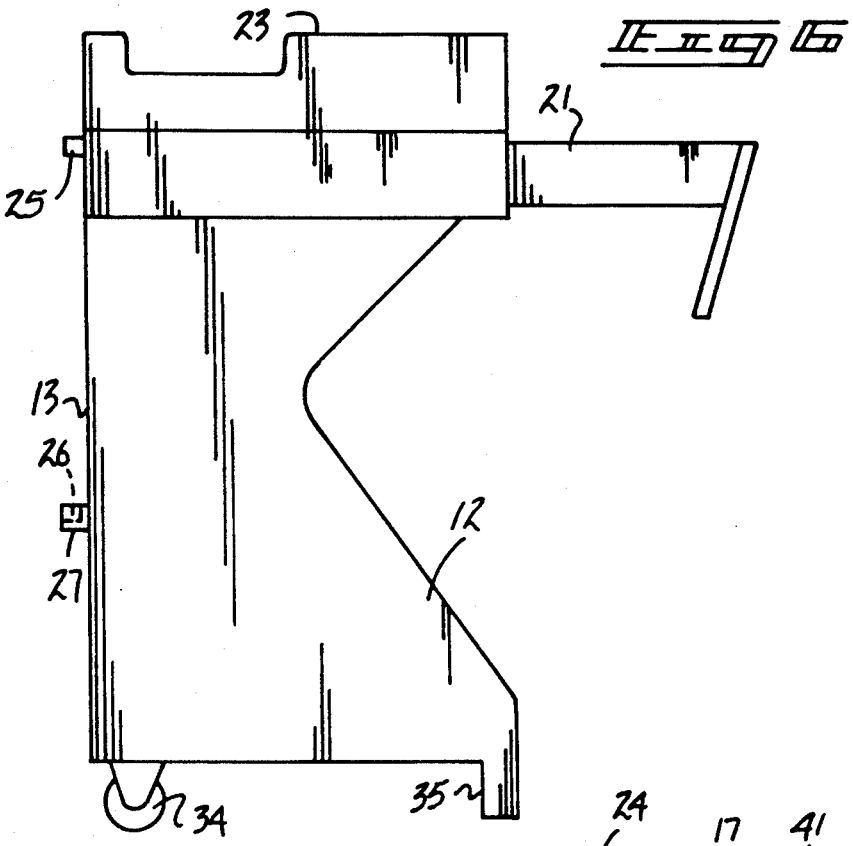
FIG. 6 is an orthographic side view, taken in elevation, of the slider bar assembly in operative association with the housing.
Figure 7:
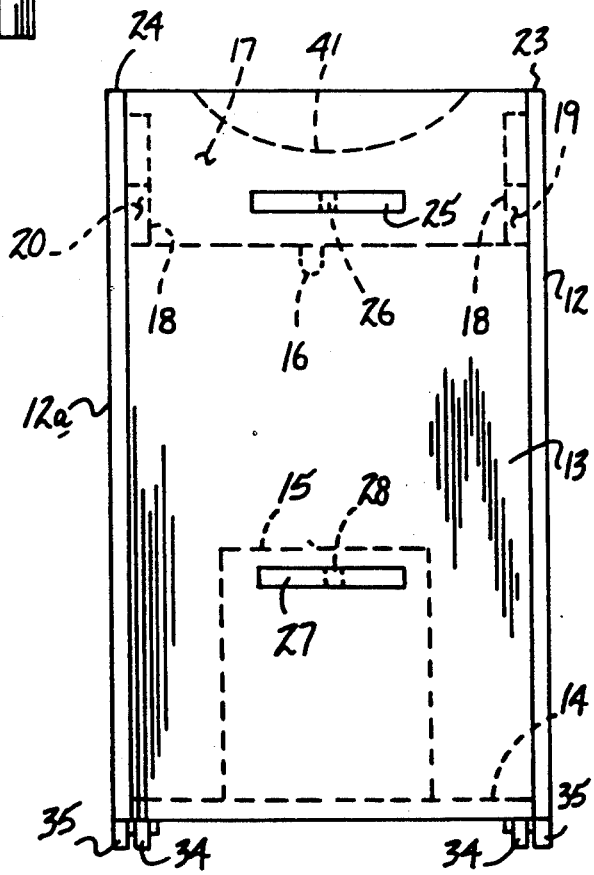
FIG. 7 is an orthographic rear view, taken in elevation, of the housing of the instant invention.

More specifically, the wheel chair shampoo apparatus 10 of the instant invention essentially comprises a housing 11 including spaced side walls defined by a right side wall 12 arranged spaced from and parallel a left side wall 12*a* that are coextensive relative to one another and include a vertical rear wall 13, with a floor 14 orthogonally mounted adjacent lower terminal ends of the side walls and rear wall. A removable bucket member 15 is mounted on the floor 14 for reception of drainage in use of the shampoo organization. The bucket member 15 is positioned coaxially underlying a fluid basin drain 16 mounted medially and to a bottom surface of a fluid basin assembly 17 (see FIG. 7). The basin assembly 17 includes basin side walls 18 mounted to the housing side walls defining a respective right and left channel 19 and 20 between the respective right and left side walls of the basin assembly 18 and the respective right and left side walls 12 and 12*a* of the housing 11. The respective right and left channels 19 and 20 slidably receive a right and left slider bar 21 and 22 (see FIG. 5*a* for example). The right and left slider bars each respectively mount a respective right and left slider abutment bar 21*a* and 22*a* that are orthogonally mounted to forward terminal ends of each right and left slider bar 21 and 22. A horizontal mounting bar 36 including a central concave portion is orthogonally directed between the right and left slider abutment bars 21*a* and 22*a* for mounting of wheel chair handle bars 38 of a wheel chair assembly 37 in a manner as illustrated in FIG. 3. The handle bars 38 are of a generally arcuate configuration at their upper terminal ends for mounting and positioning of the wheel chair assembly 37 relative to the mounting bar 36 when the slider bars 21 and 22 are extended relative to the housing from the respective right and left channels 19 and 20. This orients the wheel chair in a desired orientation relative to the fluid basin assembly 17 for positioning of an individual's head that is positioned within the wheel chair assembly 37. Understandably, the basin assembly 17 is positioned underlying a right and left side wall top edge 23 and 24, as well as the right and left channels positioned underlying the top edges 23 and 24 of the respective right and left side walls 12 and 12*a*.

The vertical rear wall 13 includes a top rear wall guide loop 25 that includes a loop bore 26 that is orthogonally directed through the guide loop 25. The top guide loop 25 is arranged above and parallel a bottom rear wall support 27 that includes a blind bore 28 that is coaxially aligned with the loop bore 26. In this manner, a vertical extent of an "L" shaped support rod 29 is directed through the loop bore 26 and through the lower end to be received within the blind bore 28. The "L" shaped support rod 29 includes a support rod horizontal leg 30 that extends overlying the basin assembly 17 mounting a water pouch 31 thereon. The water pouch or container 31 includes a fluid tube 32 directed downwardly therefrom, with a fluid tube valve 33 permitting selective fluid through the tube for the washing of hair of an individual whose head overlies the basin assembly. It should be understood that the fluid pouch 31 is pivotally mounted relative to the horizontal leg 30 to permit desired orientation and positioning of the fluid pouch relative to an individual and to positioning of the pouch relative to the underlying basin assembly 17.

In use, a plurality of rear locking casters 34 are mounted adjacent rear end portions of bottom edges of the respective right and left side walls 12 and 12*a*, with positioning legs 35 mounted to forward ends of bottom terminal ends of the right and left side walls 12 and 12*a*. In this manner, the casters 34 may be locked in position relative to a wheel chair assembly 37. The wheel chair assembly rear wheels 39 are positioned adjacent the housing 11, with the wheel chair forward wheels 40 positioned onto a wheel chair support mount 42. In this manner, an individual's neck is received within an arcuate concave basin collar 41 mounted orthogonally between upper forward end edges of the side walls 12 and 12*a*. The support mount 42 includes support mount side walls 43, with a support mount upper floor 44 spaced above a support mount lower floor 45. The upper floor 44 is positioned below upper terminal edges of the support mount side walls 43, and wherein the upper floor 44 is tilted rearwardly, wherein a forward edge 44*a* of the upper floor 44 is spaced above a rear edge 44*b* of the floor 44 to properly orient the wheel chair assembly 37 and accommodate weight distribution of an individual mounted upon the wheel chair assembly 37.

As to the manner of usage and operation of the instant invention, the same should be apparent from the above disc' sure, and accordingly no further discussion relative to the manner of usage and operation of the instant invention shall be provided.

With respect to the above description then, it is to be realized that the optimun dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wheel chair shampoo apparatus comprising, in combination, a housing, the housing including a right side wall and left side wall arranged in a spaced coextensive relationship, and a rear vertical wall mounted coextensively to rear vertical edges of the right and left side walls, and a floor mounted orthogonally relative to the rear wall and the side walls, and a removable bucket member mounted on the floor, and a fluid basin assembly mounted overlying the bucket member adjacent upper terminal edges of the right hand and left side walls, the fluid basin assembly including a fluid basin drain positioned overlying the bucket member, and slider means mounted to the housing adjacent the basin assembly, wherein the slider means is arranged for mounting handle bars of a wheel chair assembly thereon, and wherein the apparatus further includes a wheel chair support mount spaced from the housing for mounting forward wheels of the wheel chair assembly thereon, and the slider means includes a right channel and a left channel, the right channel and left channel formed within the housing between the basin assembly and respective right and left side walls of the housing, and each channel including a respective right and left slider bar slidably mounted therewithin, each slider bar including a respective abutment bar orthogonally mounted to a forward terminal end of each slider bar, and a horizontal mounting bar including a central concave portion orthogonally mounted between the abutment bars for receiving the handle bars thereon.

2. An apparatus as set forth in claim 1 wherein the support mount includes support mount side walls, the support mount side walls arranged coextensively and in a spaced relationship relative to one another, and including a lower floor fixedly and orthogonally secured to lower terminal ends of the support mount side walls, and further including a support mount upper floor, the support mount upper floor arranged in a tilted relationship relative to the lower floor, wherein a forward terminal edge of the upper floor is spaced above a lower terminal edge of the upper floor to orient the upper floor towards the wheel chair assembly when the wheel chair assembly is mounted to the slider means.

3. An apparatus as set forth in claim 2 wherein the rear wall includes a top guide loop spaced above and parallel to a bottom rear wall support, the top guide loop including a loop bore orthogonally directed through the guide loop, and the bottom rear wall support includes a blind bore, wherein the loop bore is coaxially aligned with the blind bore, and an "L" shaped rod including a vertical rod portion received through the loop bore with the lower terminal end of the vertical rod portion mounted within the blind bore, and the "L" shaped support rod including a horizontal leg, the horizontal leg pivotally mounting a water container, the water container including a fluid tube, and the fluid tube including a fluid valve for selectively directing fluid from the water container through the fluid tube, and the water container positioned overlying the basin assembly.

4. An apparatus as set forth in claim 3 wherein the floor of the housing includes a plurality of rear locking casters mounted to the floor, with a front positioning leg positioned forwardly of the locking casters for positioning the housing onto a support surface rearwardly of the wheel chair assembly.

* * * * *